US012357067B1

(12) United States Patent
Rao

(10) Patent No.: US 12,357,067 B1
(45) Date of Patent: Jul. 15, 2025

(54) GOLF AIR TRAVEL BAG

(71) Applicant: Dongguan Jierui Sports Goods Co., Ltd., Guangdong (CN)

(72) Inventor: Zuosi Rao, Changsha (CN)

( * ) Notice: Subject to any disclaimer, the term of this patent is extended or adjusted under 35 U.S.C. 154(b) by 0 days.

(21) Appl. No.: 18/806,706

(22) Filed: Aug. 16, 2024

(51) Int. Cl.

| | |
|---|---|
| ***A45C 5/14*** | (2006.01) |
| ***A45C 7/00*** | (2006.01) |
| ***A45C 13/00*** | (2006.01) |
| ***A45C 13/02*** | (2006.01) |
| ***A45C 13/10*** | (2006.01) |
| ***A45C 13/30*** | (2006.01) |

(52) U.S. Cl.
CPC ..... *A45C 5/14* (2013.01); *A45C 7/0036* (2013.01); *A45C 13/001* (2013.01); *A45C 13/02* (2013.01); *A45C 13/103* (2013.01); *A45C 13/30* (2013.01)

(58) Field of Classification Search
CPC ..... A45C 5/14; A45C 7/0036; A45C 13/001; A45C 13/02; A45C 13/103; A45C 13/30
See application file for complete search history.

(56) References Cited

U.S. PATENT DOCUMENTS

| | | | | |
|---|---|---|---|---|
| 9,345,298 | B2 * | 5/2016 | Bettua | A45C 5/03 |
| 11,731,016 | B2 * | 8/2023 | Enes | A63B 55/30 280/37 |
| 2005/0284718 | A1 * | 12/2005 | Tai | A45C 7/0077 383/4 |
| 2020/0037719 | A1 * | 2/2020 | Jaworski | A45C 5/02 |

* cited by examiner

*Primary Examiner* — Tri M Mai

(57) ABSTRACT

A golf air travel bag is disclosed in the present invention. The golf air travel bag includes a hard shell box body and a flexible bag body. The flexible bag body is connected to one end of the hard shell box body and is in communication with the hard shell box body. The flexible bag body can be folded and placed inside the hard shell box body. The flexible bag body can be stored inside the hard shell box body, the hard shell box body has a certain bearing capacity, and after the flexible bag body is stored inside the hard shell box body, the volume is greatly reduced, thereby making it easier for a manufacturer to carry out express transportation after storage, greatly reducing the cost of express transportation, facilitating the storage after use by a user, saving space for the user after storage, and improving user experience.

17 Claims, 5 Drawing Sheets

GOLF AIR TRAVEL BAG

CROSS-REFERENCE TO RELATED APPLICATIONS

The application claims priority of Chinese patent application CN2024218307009, filed on Jul. 30, 2024, which is incorporated herein by reference in its entireties.

TECHNICAL FIELD

The present invention relates to a golf air travel bag applied in the technical field of golf bags.

BACKGROUND ART

With the improvement of people's living standards, golf has gradually entered the lives of ordinary people. Golf bags, as the name suggests, are used to hold golf clubs. The golf bags are generally divided into standard ball bags, professional ball bags, stand bags, gun bags, and air travel bags. The air travel bags are designed specifically for golf enthusiasts to play on long trips. The air travel bags can better protect the golf club from damage during travel and can hold all the luggage of a user, including clothing, shoes, and so on.

However, in the prior art, the above-mentioned ball bags are either trolley cases with a completely hard shell or completely flexible backpack bodies, both of which are inconvenient for the user to store after use and occupy a large space. The trolley cases with the completely hard shell have higher transportation costs due to their larger body size, which increases the user's usage cost.

SUMMARY

For solving the problem mentioned above that golf air travel bags in the prior art are not convenient for a user to store or for a manufacturer to transport by express delivery, a golf air travel bag is provided by the present invention. In the present invention, a flexible bag body can be stored inside a hard shell box body, the hard shell box body has a certain bearing capacity, and after the flexible bag body is stored inside the hard shell box body, the volume is greatly reduced, thereby making it easier for the manufacturer to carry out express transportation after storage, greatly reducing the cost of express transportation, facilitating the storage after use by a user, saving space for the user after storage, and improving user experience.

The technical solution adopted by the present invention to solve its technical problem is as follows. A golf air travel bag is provided in the present invention. The golf air travel bag includes a hard shell box body and a flexible bag body. The flexible bag body is connected to one end of the hard shell box body and is in communication with the hard shell box body. The flexible bag body is capable of being folded and placed inside the hard shell box body.

Furthermore, the golf air travel bag also includes an opening and closing member. The hard shell box body and the flexible bag body are both capable of being closed and opened through the opening and closing member.

Furthermore, the hard shell box body includes a first upper shell and a first lower shell, and the flexible bag body includes a second upper shell and a second lower shell. The second upper shell is connected to one end of the first upper shell to form an upper shell of the golf air travel bag, and the second lower shell is connected to one end of the first lower shell to form a lower shell of the golf air travel bag. The upper shell is capable of being connected to the lower shell through the opening and closing member.

Furthermore, when the upper shell is separated from the lower shell through the opening and closing member, the first upper shell is capable of being flipped 180° through the second upper shell. When the first upper shell is flipped 180°, the first upper shell is capable of being stacked on the first lower shell, and an outer side surface of a bottom wall of the first upper shell abuts against an inner side surface of a bottom wall of the first lower shell. The second upper shell is positioned on the second lower shell to form a foldable state of the flexible bag body. When the flexible bag body is in the foldable state, the flexible bag body is capable of being placed inside the first upper shell after folding, so that the golf air travel bag is in a packed state.

Furthermore, the second lower shell includes a first side wall, a second side wall, a third side wall, and a fourth side wall. The second side wall is arranged opposite to the fourth side wall, and the third side wall is connected to the second side wall and the fourth side wall. The first side wall includes four connecting side edges. The second side wall, the third side wall, and the fourth side wall are respectively connected to three of the four connecting side edges. One end of the second upper shell is fixedly connected to another side edge of the first side wall, and the second upper shell is connected to the second side wall and the fourth side wall through the opening and closing member.

Furthermore, the flexible bag body further includes a supporting plate. The supporting plate is arranged on the first side wall.

Furthermore, the golf air travel bag also includes sliding wheels. The sliding wheels are arranged on an outer side surface of the first side wall.

Furthermore, the golf air travel bag further includes foot pads. The foot pads are arranged on the outer side surface of the first side wall.

Furthermore, the golf air travel bag further includes a binding member. The flexible bag body is capable of being completely placed inside the first upper shell after folding. When the flexible bag body is completely placed inside the first upper shell after folding, the binding member is used for fixing the flexible bag body inside the first upper shell, so that the golf air travel bag is in a fixed packed state.

Furthermore, when the golf air travel bag is in the fixed packed state, the golf air travel bag is less than 10 inches in height, less than 16 inches in width, and less than 20 inches in length.

Furthermore, when the golf air travel bag is in an unfolded state, a length of the golf air travel bag is less than 60 inches.

Furthermore, the opening and closing member is a zipper.

Furthermore, the flexible bag body is equipped with more than one pocket.

Furthermore, a front surface of the flexible bag body is equipped with a first handle.

Furthermore, the flexible bag body is equipped with a bag tightening component.

Furthermore, the flexible bag body is equipped with two bag tightening components. One bag tightening component is positioned near the hard shell box body, and an opposite bag tightening component is positioned away from the hard shell box body.

Furthermore, a handheld strap is provided between the two bag tightening components. The first handle is positioned at one end away from the hard shell box body.

Furthermore, the bag tightening component includes a first connecting strap, a second connecting strap, a buckle member, and a buckle fitting member. A first end of the first connecting strap is connected to a side surface of the flexible bag body, and a first end of the second connecting strap is connected to another side surface of the flexible bag body. The side surface of the flexible bag body connected to the first end of the first connecting strap is opposite to the other side surface of the flexible bag body connected to the first end of the second connecting strap. The buckle member is provided at a second end of the first connecting strap, and the buckle fitting member is provided at a second end of the second connecting strap. The buckle member and the buckle fitting member are capable of being interlocked.

Furthermore, the handheld strap includes a third connecting strap, a fourth connecting strap, and a connecting member. Two ends of the third connecting strap are connected to a side surface of the flexible bag body, and the two ends of the third connecting strap are arranged at a distance. Two ends of the fourth connecting strap are connected to another side surface of the flexible bag body, and the two ends of the third connecting strap are arranged at a distance. The side surface of the flexible bag body connected to the two ends of the third connecting strap is opposite to the other side surface of the flexible bag body connected to the two ends of the fourth connecting strap. The third connecting strap and the fourth connecting strap are connected by the connecting member.

Furthermore, the hard shell box body is equipped with a second handle at one end away from the flexible bag body.

Beneficial effects of the present invention are as follows. The golf air travel bag is provided by the present invention. The flexible bag body can be stored inside the hard shell box body, the hard shell box body has a certain bearing capacity, and after the flexible bag body is stored inside the hard shell box body, the volume is greatly reduced, thereby making it easier for the manufacturer to carry out express transportation after storage, greatly reducing the cost of express transportation, facilitating the storage after use by a user, saving space for the user after storage, and improving user experience.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

REFERENCE NUMERALS

Figure 1:
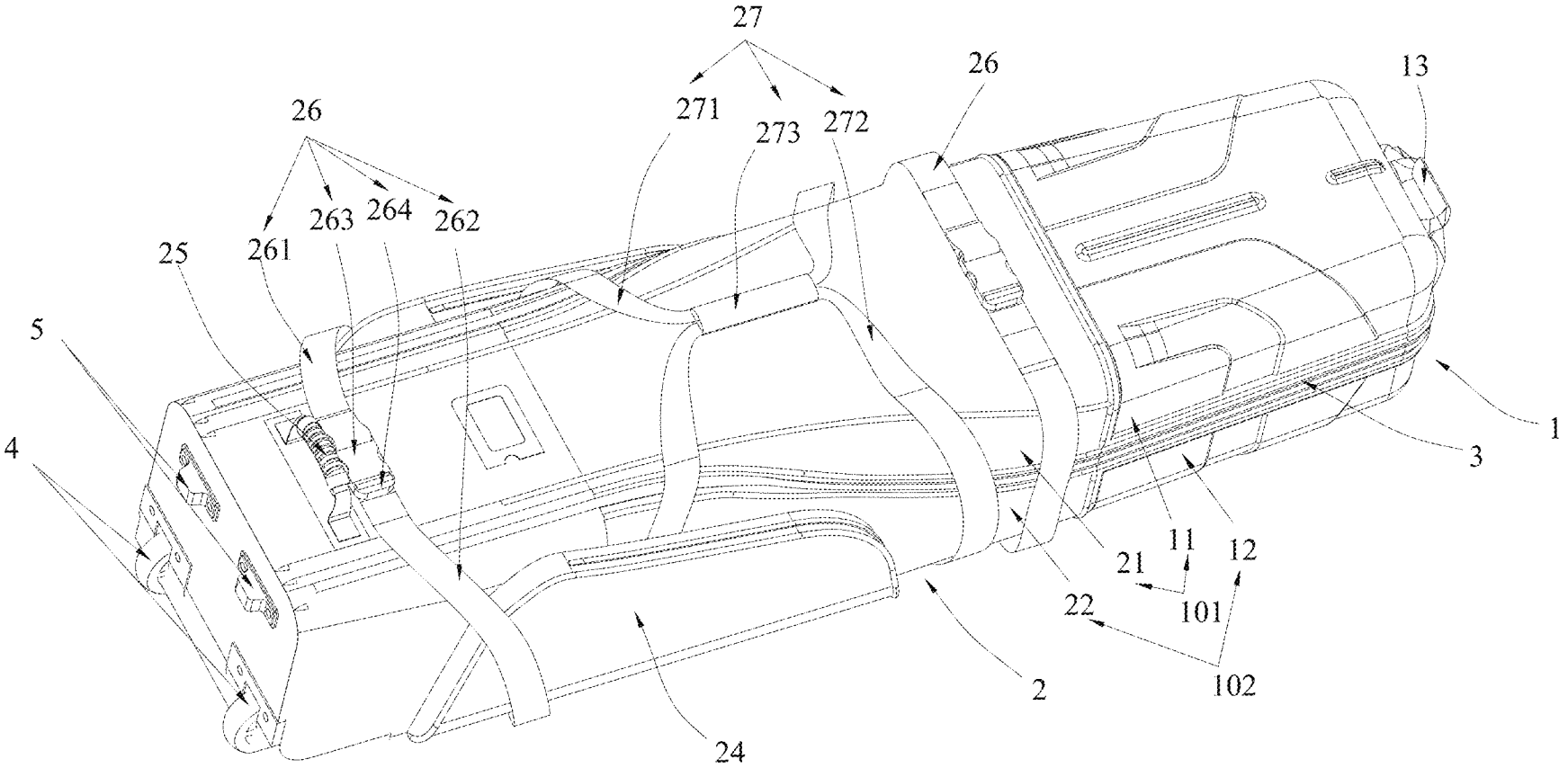
FIG. 1 is a perspective view of a golf air travel bag according to the present invention.

Upper shell 101; lower shell 102; hard shell box body 1; first upper shell 11; outer side surface 110 of a bottom wall of the first upper shell 11; first lower shell 12; inner side surface 120 of a bottom wall of the first lower shell 12; second handle 13; flexible bag body; second upper shell 21; second lower shell 22; first side wall 221; second side wall 222; third side wall 223; fourth side wall 224; supporting plate 23; pocket 24; first handle 25; tightening component 26; first connecting strap 261; second connecting strap 262; buckle member 263; buckle fitting member 264; handheld strap 27; third connecting strap 271; fourth connecting strap 272; connecting member 273; opening and closing member 3; sliding wheel 4; foot pad 5; binding member 6.

DETAILED DESCRIPTION OF THE EMBODIMENTS

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Referring to FIGS. 1-5, a golf air travel bag is provided in the present invention. The golf air travel bag includes a hard shell box body 1 and a flexible bag body 2. The flexible bag body 2 is made of fabric. The flexible bag body 2 is connected to one end of the hard shell box body 1 and is in communication with the hard shell box body 1. The flexible bag body 2 is capable of being folded and placed inside the hard shell box body 1. That is to say, the flexible bag body can be stored inside the hard shell box body, the hard shell box body has a certain bearing capacity, and after the flexible bag body is stored inside the hard shell box body, the volume is greatly reduced, which makes it easier for a manufacturer to carry out express transportation after storage. Compared with a golf bag that is a hard shell body as a whole, the golf air travel bag greatly reduces the cost of express transportation. Compared with a golf bag that is a flexible as a whole, the golf air travel bag is easier for a user to store after use, saves space for the user after storage, and improves user experience. The golf bag that is flexible as a whole is either hung in a certain place, making the whole room uncoordinated and occupying space, or folded and packaged randomly, making the bag easy to deform, and making the bag not only unsightly, but also difficult to fit golf equipment components in the later use. In the present embodiment, the hard shell box body and the flexible bag body are used in combination, and the flexible bag body needs to be folded into the hard shell box body regularly and cannot be folded arbitrarily, otherwise the flexible bag body cannot be loaded into the hard shell box body, thus avoiding the deformation of the flexible bag body after folding and improving the user experience.

In this embodiment, the golf air travel bag also includes an opening and closing member 3. The hard shell box body 1 and the flexible bag body 2 are both capable of being closed and opened through the opening and closing member 3. The opening and closing member can be a snap fastener, a locking member, or a zipper. In this embodiment, it is preferred to use the zipper. The zipper is convenient for the user to open and close, and the cost of arranging the zipper is low.

In this embodiment, the box body and the bag body are fixedly connected. The zipper is arranged on a connecting side surface of the bag body and the box body, and on a side surface of the box body away from the bag body. Therefore, the zipper is arranged in a U-shape as a whole. When the zipper is pulled from one end to the other end, the golf air travel bag is in an open state.

In this embodiment, the hard shell box body 1 includes a first upper shell 11 and a first lower shell 12, and the flexible bag body 2 includes a second upper shell 21 and a second lower shell 22. The second upper shell 21 is connected to one end of the first upper shell 11 to form an upper shell 101 of the golf air travel bag, and the second lower shell 22 is connected to one end of the first lower shell 12 to form a lower shell 102 of the golf air travel bag. The upper shell 101 is capable of being connected to the lower shell 102 through the opening and closing member 3. Therefore, the golf air travel bag as a whole is divided into two parts, the upper shell and the lower shell, with a simple structure and easy assembly.

Figure 2:
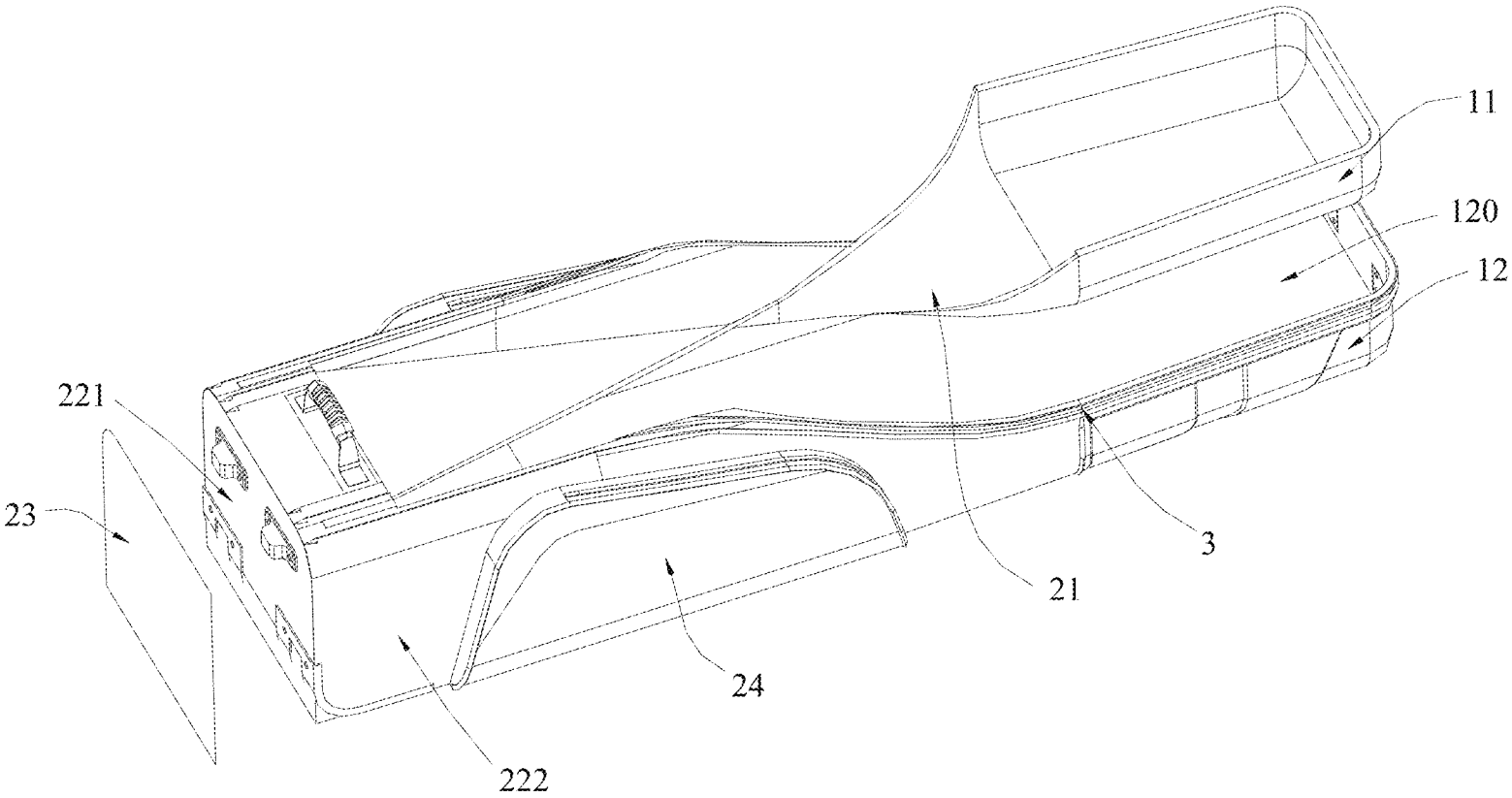
FIG. 2 is a diagram of a first upper shell in a flipped and folded state according to the present invention.
Figure 3:
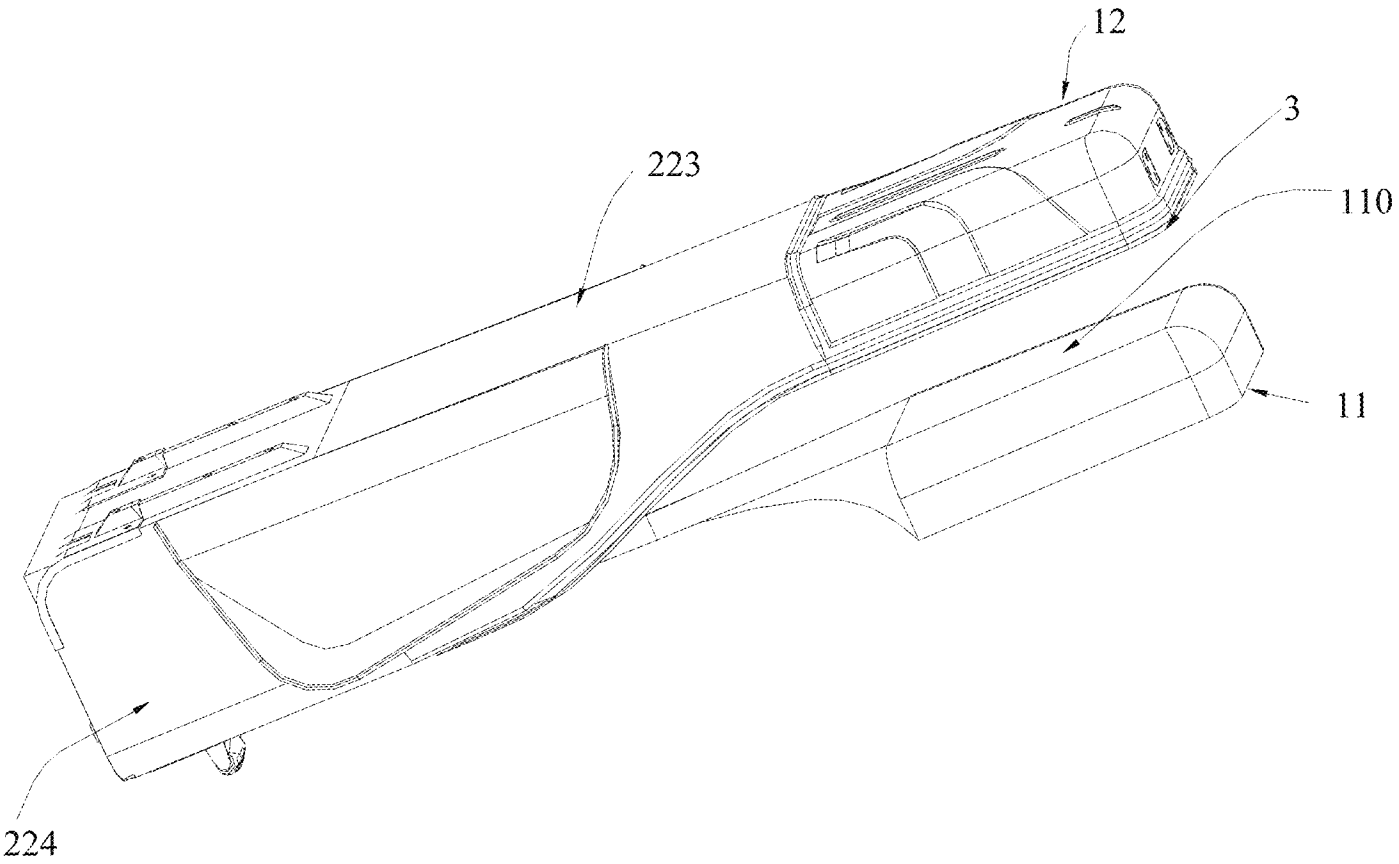
FIG. 3 is a diagram of FIG. 2 from another angle of view according to the present invention.
Figure 4:
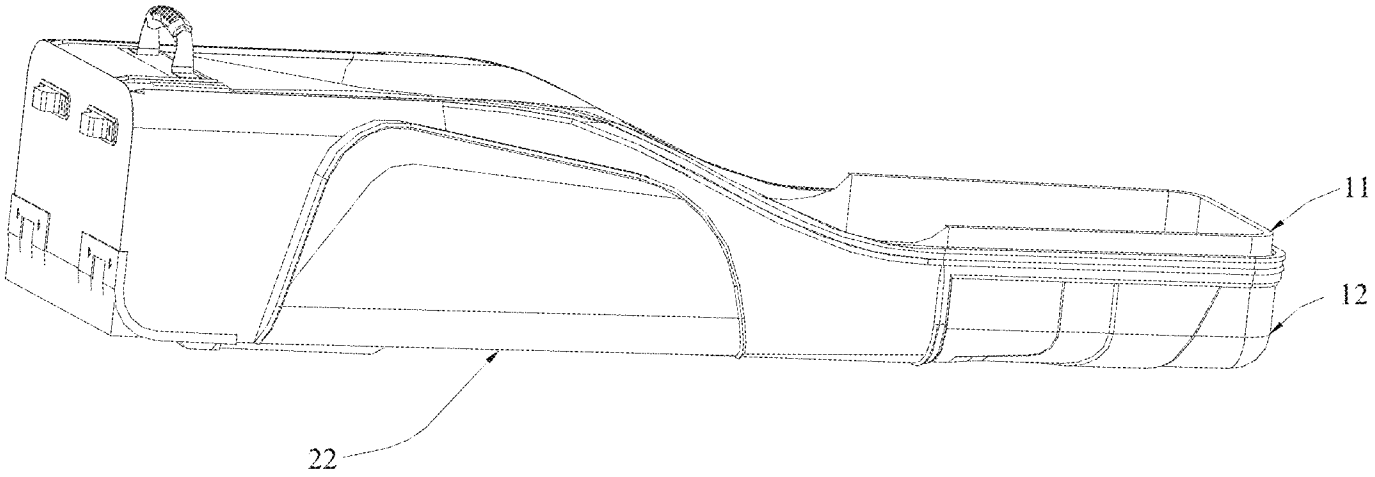
FIG. 4 is a state diagram of a first upper shell stacked on a first lower shell according to the present invention.

In this embodiment, as shown in FIGS. 2-3, when the upper shell 101 is separated from the lower shell 102 through the opening and closing member 3, the first upper shell 11 is capable of being flipped 180° through the second upper shell 21. When the first upper shell 11 is flipped 180°, the first upper shell 11 is capable of being stacked on the first lower shell 12, and an outer side surface 110 of a bottom wall of the first upper shell 11 abuts against an inner side surface 120 of a bottom wall of the first lower shell 12. The second upper shell 21 is positioned on the second lower shell 22 to form a foldable state of the flexible bag body 2. The second upper shell 21 is positioned on the second lower shell 22, which can be either the second upper shell 21 is positioned inside the second lower shell 22, or the second upper shell 21 is placed on an upper surface, a bottom surface or a side surface of the second lower shell 2 after the second lower shell 22 is folded, etc., and then the flexible bag body is folded as a whole. In this embodiment, it is preferred to choose the second upper shell 21 to be positioned inside the second lower shell 22. When the flexible bag body 2 is in the foldable state, the flexible bag body 2 can be folded and then placed inside the first upper shell 11, so that the golf air travel bag is in a packed state, reducing the volume of the entire golf air travel bag, facilitating express transportation by the manufacturer, and facilitating storage by the user.

In this embodiment, the second lower shell 22 includes a first side wall 221, a second side wall 222, a third side wall 223, and a fourth side wall 224. The second side wall 222 is arranged opposite to the fourth side wall 224, and the third side wall 223 is connected to the second side wall 222 and the fourth side wall 224. The first side wall 221 includes four connecting side edges. The second side wall 222, the third side wall 223, and the fourth side wall 224 are respectively connected to three of the four connecting side edges. One end of the second upper shell 21 is fixedly connected to another side edge of the first side wall 221, and the second upper shell 21 is connected to the second side wall 222 and the fourth side wall 224 through the opening and closing member 3. That is to say, one end of the first upper shell is fixedly connected to a connecting side edge of the first side wall of the second lower shell, as shown in FIGS. 1-2, it is preferable for a connecting end of the first upper shell to be a separate side wall that covers a front surface of the flexible bag body, so that the first upper shell can be flipped 180 degrees, and the flexible bag body can be easily folded and packed into the hard shell box body.

In this embodiment, the flexible bag body 2 further includes a supporting plate 23. The supporting plate 23 can be fixedly mounted on the first side wall 221 or detachably mounted on the first side wall 221, can be mounted inside the flexible bag body or on an outer side surface of the fourth side wall 224, and can also be sewn into the fourth side wall. The setting of the supporting plate is not limited here, and the main function of the supporting plate is to support a bottom portion of the flexible bag body, protect a golf ball component placed inside the package, and prevent the bottom portion from touching the ground and damaging the golf ball component.

In this embodiment, the golf air travel bag also includes sliding wheels 4. The sliding wheels 4 are arranged on an outer side surface of the first side wall 221 to facilitate the user's carrying and movement of the golf air travel bag with the golf ball component inside. The sliding wheels 4 can be universal wheels.

In this embodiment, the golf air travel bag further includes foot pads 5. The foot pads 5 are arranged on the outer side surface of the first side wall 221, so that when the user vertically places the golf air travel bag with golf components inside, a bottom surface of the golf air travel bag can be prevented from touching the ground, and the golf air travel bag can be prevented from being dirty.

Figure 5:
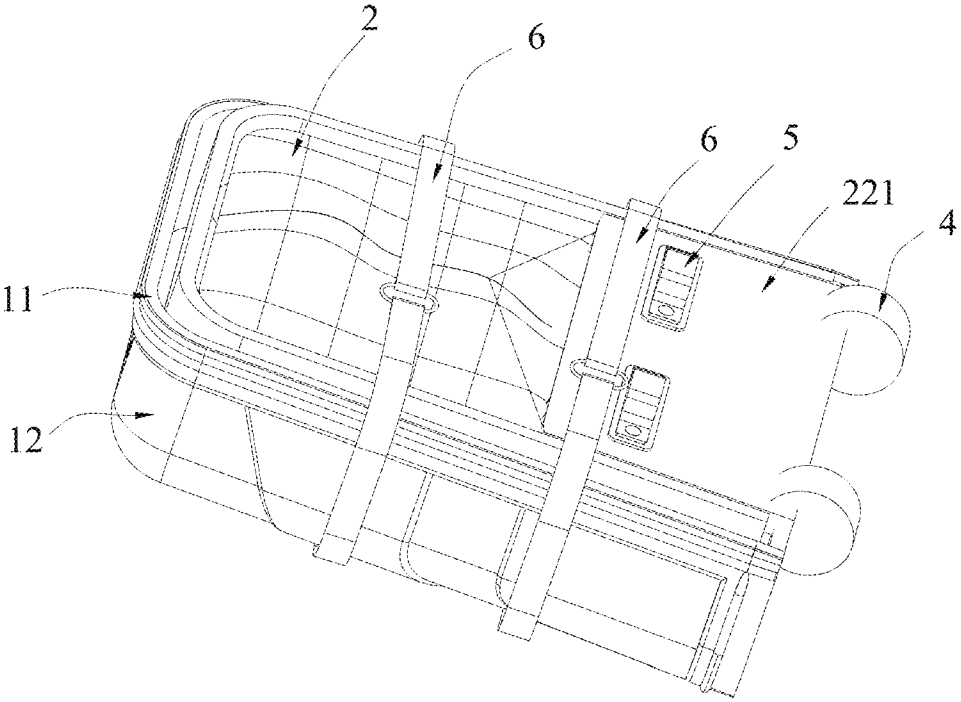
FIG. 5 is a diagram of a golf air travel bag in a fixed packed state according to the present invention.

In this embodiment, as shown in FIG. 5, the golf air travel bag further includes a binding member 6. After the flexible bag body 2 is folded, the flexible bag body 2 is capable of being completely placed inside the first upper shell 11. When the flexible bag body 2 is completely placed inside the first upper shell 11 after folding, the binding member 6 is used for fixing the flexible bag body 2 inside the first upper shell 11, so that the golf air travel bag is in a fixed packed state, which is convenient for transportation and storage. As shown in FIG. 5, the binding member 6 includes a belt body and an adjusting member. The adjusting member is fixedly arranged at one end of the belt body, and an opposite end of the belt body can pass through an adjusting opening defined in the adjusting member. A first side surface of the belt body is a loop surface of hook and loop fastener, and a second side surface of the belt body is a hook surface of hook and loop fastener. After the belt body passes through the adjusting opening defined in the adjusting member, the hook surface of hook and loop fastener of the belt body can be adhered to the loop surface of hook and loop fastener of the belt body.

In this embodiment, when the golf air travel bag is in the fixed packed state, the golf air travel bag is less than 10 inches in height, less than 16 inches in width, and less than 20 inches in length. Preferably, the height of the golf air travel bag is less than 8 inches, the width is less than 14 inches, and the length is less than 18 inches, because this size is within the standard range of express transportation costs in the United States. Within the standard range refers to the volume and weight do not exceed the specified relevant values, and there will be no increase in express transportation costs within the specified relevant value range. If it exceeds the specified relevant value range, a certain express delivery fee will be added, and the higher the express delivery fee, the higher the cost of the purchased product. Therefore, in this embodiment, the height of the golf air travel bag is less than 8 inches, the width is less than 14 inches, and the length is less than 18 inches, which are within the specified volume value range and save the user's purchasing costs, thereby greatly increasing user's purchasing desire. However, the golf air travel bag can also be arranged to be less than 10 inches in height, less than 16 inches in width, and less than 20 inches in length. In the case where the user really doesn't know how to pack, the size may exceed the standard range of express data. Therefore, the overall size range can be controlled within a height of less than 10 inches, a width of less than 16 inches, and a length of less than 20 inches. The length, width, and height mentioned here can be understood as a first length, a second length, and a third length of the entire object. That is to say, when judging a fixed state of the golf air travel bag after packing, the longest length is the first length, the shorter length compared with the first length is the second length, and the shorter length compared with the second length is the third length.

In this embodiment, when the golf air travel bag is in an unfolded state, a length of the golf air travel bag is less than 60 inches.

In this embodiment, the flexible bag body 2 is equipped with more than one pocket 24, which facilitates the user to place other items and increases the practicality of the golf air travel bag.

In this embodiment, the front surface of the flexible bag body 2 is equipped with a first handle 25.

In this embodiment, the flexible bag body 2 is equipped with a bag tightening component 26 to tighten the flexible bag body and prevent the golf ball component from shaking in the golf air travel bag.

In this embodiment, the flexible bag body 2 is equipped with two bag tightening components 26. One bag tightening component 26 is positioned near the hard shell box body 1, and an opposite bag tightening component 26 is positioned away from the hard shell box body 1. The two bag tightening components 26 tighten the flexible bag body, making the golf ball component more stable inside the golf air travel bag.

In this embodiment, a handheld strap 27 is provided between the two bag tightening components 26. The first handle 25 is positioned at one end away from the hard shell box body 1, making it convenient for the user to carry the golf air travel bag.

In this embodiment, the bag tightening component 26 includes a first connecting strap 261, a second connecting strap 262, a buckle member 263, and a buckle fitting member 264. A first end of the first connecting strap 261 is connected to a side surface of the flexible bag body 2, and a first end of the second connecting strap 262 is connected to another side surface of the flexible bag body 2. The side surface of the flexible bag body 2 connected to the first end of the first connecting strap 261 is opposite to the other side surface of the flexible bag body 2 connected to the first end of the second connecting strap 262. The buckle member 263 is provided at a second end of the first connecting strap 261, and the buckle fitting member 264 is provided at a second end of the second connecting strap 262. The buckle member 263 and the buckle fitting member 264 are capable of being interlocked, and the buckle member 263 and the buckle fitting member 264 are positioned on the front surface of flexible bag body 2 after interlocking.

In this embodiment, the handheld strap 27 includes a third connecting strap 271, a fourth connecting strap 272, and a connecting member 273. Two ends of the third connecting strap 271 are connected to a side surface of the flexible bag body 2, and the two ends of the third connecting strap 271 are arranged at a distance. Two ends of the fourth connecting strap 272 are connected to another side surface of the flexible bag body 2, and the two ends of the third connecting strap 271 are arranged at a distance. The side surface of the flexible bag body 2 connected to the two ends of the third connecting strap 271 is opposite to the other side surface of the flexible bag body 2 connected to the two ends of the fourth connecting strap 272. The third connecting strap 271 and the fourth connecting strap 272 are connected by the connecting member 273. When the third connecting strap 271 and the fourth connecting strap 272 are connected by the connecting member 273, the connecting member 273 is positioned on the front surface of the flexible bag body 2.

In this embodiment, the hard shell box body 1 is equipped with a second handle 13 at one end away from the flexible bag body 2, which facilitates the movement of the golf air travel bag with the golf ball component inside by the user.

In summary, the golf air travel bag in this embodiment is convenient for express transportation, easy for the user to store, simple in structure, easy to assemble, and is relatively durable with the protection of the hard shell box body. Overall, the user experience is improved.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A golf air travel bag, comprising a hard shell box body and a flexible bag body, wherein the flexible bag body is connected to one end of the hard shell box body and is in communication with the hard shell box body, and the flexible bag body is capable of being folded and placed inside the hard shell box body, wherein the golf air travel bag also comprises an opening and closing member, and the hard shell box body and the flexible bag body are both capable of being closed and opened through the opening and closing member, wherein the hard shell box body comprises a first upper shell and a first lower shell, the flexible bag body comprises a second upper shell and a second lower shell, the second upper shell is connected to one end of the first upper shell to form an upper shell of the golf air travel bag, the second lower shell is connected to one end of the first lower shell to form a lower shell of the golf air travel bag, and the upper shell is capable of being connected to the lower shell through the opening and closing member, wherein when the upper shell is separated from the lower shell through the opening and closing member, the first upper shell is capable of being flipped 180° through the second upper shell; when the first upper shell is flipped 180°, the first upper shell is capable of being stacked on the first lower shell, an outer side surface of a bottom wall of the first upper shell abuts against an inner side surface of a bottom wall of the first lower shell, and the second upper shell is positioned on the second lower shell to form a foldable state of the flexible bag body; when the flexible bag body is in the foldable state, the flexible bag body is capable of being placed inside the first upper shell after folding, so that the golf air travel bag is in a packed state.

2. The golf air travel bag according to claim 1, wherein the second lower shell comprises a first side wall, a second side wall, a third side wall, and a fourth side wall; the second side wall is arranged opposite to the fourth side wall, the third side wall is connected to the second side wall and the fourth side wall, and the first side wall comprises four connecting side edges; the second side wall, the third side wall, and the fourth side wall are respectively connected to three of the four connecting side edges; one end of the second upper shell is fixedly connected to another side edge of the first side wall, and the second upper shell is connected to the second side wall and the fourth side wall through the opening and closing member.

3. The golf air travel bag according to claim 2, wherein the flexible bag body further comprises a supporting plate, and the supporting plate is arranged on the first side wall.

4. The golf air travel bag according to claim 2, wherein the golf air travel bag also comprises sliding wheels, and the sliding wheels are arranged on an outer side surface of the first side wall.

5. The golf air travel bag according to claim 3, wherein the golf air travel bag further comprises foot pads, and the foot pads are arranged on the outer side surface of the first side wall.

6. The golf air travel bag according to claim 1, wherein the golf air travel bag further comprises a binding member, and the flexible bag body is capable of being completely placed inside the first upper shell after folding; when the flexible bag body is completely placed inside the first upper shell after folding, the binding member is used for fixing the flexible bag body inside the first upper shell, so that the golf air travel bag is in a fixed packed state.

7. The golf air travel bag according to claim 6, wherein when the golf air travel bag is in the fixed packed state, the golf air travel bag is less than 10 inches in height, less than 16 inches in width, and less than 20 inches in length.

8. The golf air travel bag according to claim 7, wherein when the golf air travel bag is in an unfolded state, a length of the golf air travel bag is less than 60 inches.

9. The golf air travel bag according to claim 1, wherein the opening and closing member is a zipper.

10. The golf air travel bag according to claim 1, wherein the flexible bag body is equipped with more than one pocket.

11. The golf air travel bag according to claim 1, wherein a front surface of the flexible bag body is equipped with a first handle.

12. The golf air travel bag according to claim 11, wherein the flexible bag body is equipped with a bag tightening component.

13. The golf air travel bag according to claim 12, wherein the flexible bag body is equipped with two bag tightening components, one bag tightening component is positioned near the hard shell box body, and an opposite bag tightening component is positioned away from the hard shell box body.

14. The golf air travel bag according to claim 13, wherein a handheld strap is provided between the two bag tightening components, and the first handle is positioned at one end away from the hard shell box body.

15. The golf air travel bag according to claim 12, wherein the bag tightening component comprises a first connecting strap, a second connecting strap, a buckle member, and a buckle fitting member; a first end of the first connecting strap is connected to a side surface of the flexible bag body, a first end of the second connecting strap is connected to another side surface of the flexible bag body, the side surface of the flexible bag body connected to the first end of the first connecting strap is opposite to the other side surface of the flexible bag body connected to the first end of the second connecting strap, the buckle member is provided at a second end of the first connecting strap, the buckle fitting member is provided at a second end of the second connecting strap, and the buckle member and the buckle fitting member are capable of being interlocked.

16. The golf air travel bag according to claim 14, wherein the handheld strap comprises a third connecting strap, a fourth connecting strap, and a connecting member; two ends of the third connecting strap are connected to a side surface of the flexible bag body, the two ends of the third connecting strap are arranged at a distance, two ends of the fourth connecting strap are connected to another side surface of the flexible bag body, the two ends of the third connecting strap are arranged at a distance, the side surface of the flexible bag body connected to the two ends of the third connecting strap is opposite to the other side surface of the flexible bag body connected to the two ends of the fourth connecting strap, and the third connecting strap and the fourth connecting strap are connected by the connecting member.

17. The golf air travel bag according to claim 1, wherein the hard shell box body is equipped with a second handle at one end away from the flexible bag body.

* * * * *